US005122641A

United States Patent [19]

DeChurch

[11] Patent Number: 5,122,641

[45] Date of Patent: Jun. 16, 1992

[54] SELF-REGULATING HEATING CABLE COMPOSITIONS THEREFOR, AND METHOD

[75] Inventor: Robert M. DeChurch, Bainbridge, Ohio

[73] Assignee: Furon Company, Laguna Niguel, Calif.

[21] Appl. No.: 527,527

[22] Filed: May 23, 1990

[51] Int. Cl.[5] ..... H05B 3/10

[52] U.S. Cl. ..... 219/548; 219/528; 219/529; 219/549; 219/553; 219/535; 29/611; 156/85; 156/87; 338/22 R; 252/511; 252/512

[58] Field of Search ..... 219/548, 549, 553, 529, 219/528; 29/611, 619, 621; 156/85, 87, 308.2, 292, 300, 309.6; 338/22 R, 214, 212; 252/511, 512, 518

[56] References Cited

U.S. PATENT DOCUMENTS

| | | | |
|---|---|---|---|
| 2,453,557 | 11/1948 | Voet | 106/32 |
| 3,054,662 | 9/1962 | Gessler | 241/123 |
| 4,200,973 | 5/1980 | Farkas | 29/611 |
| 4,237,441 | 12/1980 | van Konynenburg et al. | 338/22 R |
| 4,273,294 | 6/1981 | Hollely et al. | 241/18 |
| 4,277,673 | 7/1981 | Kelly | 219/528 |
| 4,327,480 | 5/1982 | Kelly | 29/611 |
| 4,334,148 | 6/1982 | Kampa | 219/553 |
| 4,388,607 | 6/1983 | Toy et al. | 338/22 SD |
| 4,400,614 | 8/1983 | Sopony | 219/528 |
| 4,514,620 | 4/1985 | Cheng et al. | 219/553 |
| 4,534,889 | 8/1985 | van Konynenburg et al. | 252/511 |
| 4,543,474 | 9/1985 | Horsma et al. | 219/553 |
| 4,560,498 | 12/1985 | Horsma et al. | 252/511 |
| 4,591,700 | 5/1986 | Sopory | 219/505 |
| 4,624,990 | 11/1986 | Lunk et al. | 525/199 |
| 4,658,121 | 4/1987 | Horsma et al. | 219/553 |
| 4,775,778 | 10/1988 | van Konynenburg et al. | 219/549 |
| 4,818,439 | 4/1989 | Blackledge et al. | 252/511 |
| 4,839,114 | 6/1989 | Delphin et al. | 264/40.4 |
| 4,849,133 | 7/1989 | Yoshida et al. | 252/511 |
| 4,857,880 | 8/1989 | Au et al. | 338/22 R |
| 4,859,836 | 8/1989 | Lunk et al. | 219/505 |
| 4,866,253 | 9/1989 | Kamath et al. | 219/548 |
| 4,876,440 | 10/1989 | Kamath et al. | 219/548 |
| 4,908,156 | 3/1990 | Dalle et al. | 252/511 |

*Primary Examiner*—Bruce A. Reynolds
*Assistant Examiner*—Tu Hoang
*Attorney, Agent, or Firm*—Fay, Sharpe, Beall, Fagan, Minnich & McKee

[57] ABSTRACT

A method for producing a self-regulating heating cable is provided. A first conductive constituent is cryogenically cooled to a temperature at least as low as its glass transition temperature, and ground into first conductive pellets. A second conductive constituent is cryogenically cooled to a temperature at least as low as its glass transition temperature and ground into second conductive pellets. The first and second conductive pellets are combined to obtain a mixture which is extruded over a pair of conductive wires to form a cable.

20 Claims, 2 Drawing Sheets

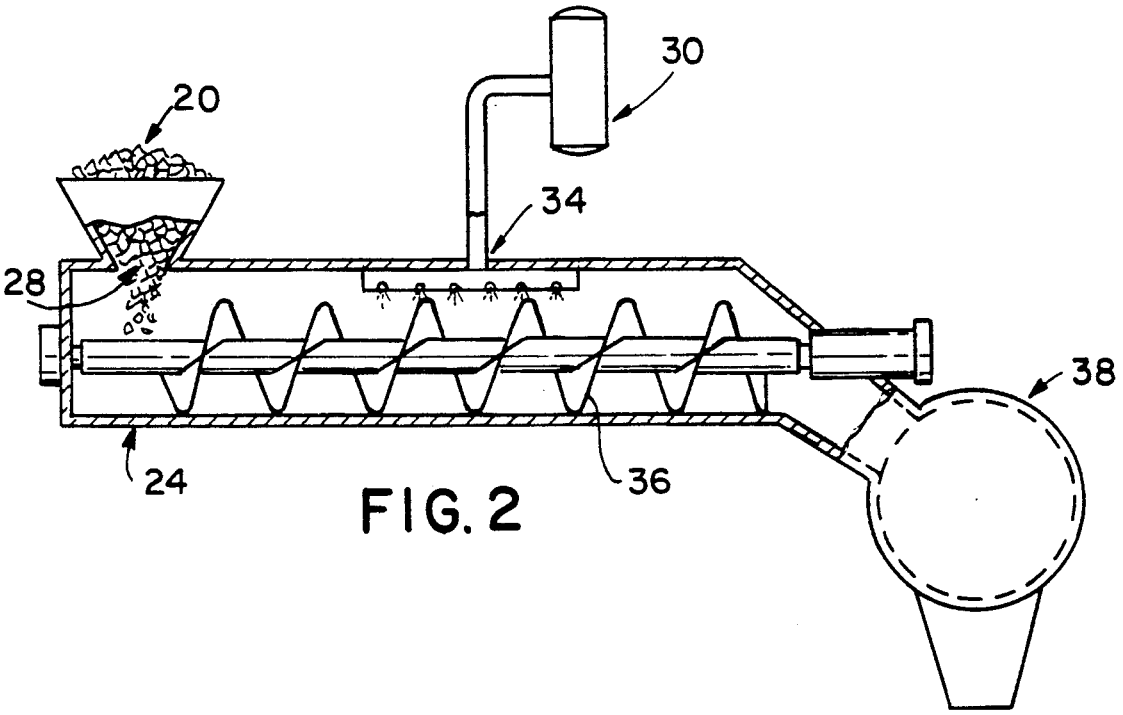
FIG. 2
FIG. 3
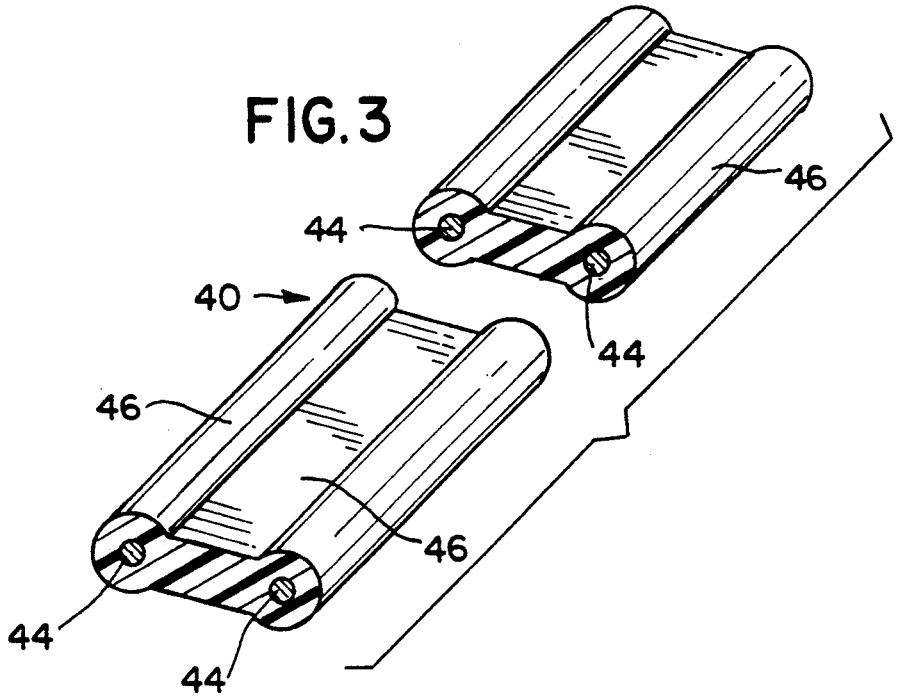

SELF-REGULATING HEATING CABLE COMPOSITIONS THEREFOR, AND METHOD

BACKGROUND OF THE INVENTION

This invention pertains to the art of heating cables and more particularly to self-regulating heating cables.

The invention is particularly applicable to heating cables comprised of conductive polymeric compositions, and will be described with particular reference thereto. It will be appreciated, however, that the invention has broader applications and may be advantageously employed in other environments.

A self-regulating heater is essentially comprised of a pair of parallel wires or conductors which are joined together by a semi-conductive, substantially polymeric material. The resistance of the material changes relative to changes in temperature. When a power source is connected to the heater and a particular voltage is applied, the heater begins to heat and thus changes its own internal resistance. The output of the heater at a given voltage thus changes in relation to the heat transfer between the heater and surroundings. The heater's construction allows it to limit itself at any given temperature below its continuous use temperature.

Self-regulating heating cables of the present invention are typically used in association with fluid carrying pipes, although they are also used to provide underground warmth for gardens and walkways. The purpose of the heating cables is to maintain a temperature which does not drop below a predetermined minimum.

In the case of water pipes, for example, it is important to prevent water within the pipe from freezing and either blocking the flow of water therethrough, or bursting the pipe to cause extensive damage. Self-regulating heating cables of the present invention are wrapped around the pipes, typically in a spiraled fashion, and serve to provide heat to the pipe as the surrounding temperatures decrease. Once surrounding temperatures begin to rise, a lesser amount of heat is transferred to the water pipe.

Heretofore, self-regulating heating cables have not dependably and predictably prevented fluids within pipes from freezing. That is to say, they have not been able to provide an even, predictable distribution of heat along their entire lengths. In some instances, portions of existing heating cable have not transferred any heat at all.

More recently, it has been discovered that predominantly uniform control of self-regulating heating cables can be obtained by substantially evenly distributing conductive filler throughout the polymeric coating which covers the parallel wire conductors prior to extrusion. A uniform dispersion of conductive material throughout a self-regulating heating cable permits the cable's resistance level to approach uniformity as well. With this knowledge in hand, previous attempts have been made to manufacture consistently operable self-regulating heating cables.

One such prior method involves compounding a given percentage of conductive carbon black with a polymer system, and extruding the resultant compound directly into cable. This method yields a product having non-uniform resistance. The non-uniformity results from the inherent difficulty of metering the amount of conductive filler dispersed in the polymer, as well as the extreme sensitivity of resistance due to mixing. Simply compounding the filler with the polymer does not result in uniform dispersion of filler. As little as a 0.25 percent deviation of conductive filler concentration throughout the system results in a $1 \times 10^2$ ohms-feet magnitude resistance oscillation. Such an inconsistent variation in resistance within a single heating cable is undesirable and renders the resulting heating cable defective for many applications.

A second previously existing method which has been followed in an effort to obtain a desired resistance throughout a self-regulating heating cable calls for the use of standard color concentrating techniques. That is, a first polymeric constituent which includes a relatively high percentage of conductive filler is mixed with a second polymeric constituent which includes no conductive filler. The constituents are blended together. The resistance of the mixture can then be adjusted by adding or subtracting the constituent containing the conductive filler.

While this second method offers a greater dissemination of filler throughout the polymer, extreme resistance uniformity problems similar to those developed in the first method arise. Heaters produced using the polymeric compound blended in accordance with the second method are essentially undesirable.

A third method for improving the uniformity in a self-regulating heating cable involves the modification of the second method discussed above. In this third case, however, both constituents contain some conductive filler. That is, the conductivity of the first constituent is slightly greater than the desired resultant conductivity. Similarly, the conductivity of the second constituent is slightly lower than the desired resultant conductivity. Appropriate amounts of the two constituents are combined to obtain a polymeric material which will approximate the desired resultant conductivity throughout.

Because the probability of having the desired amount of conductive filler at any point in the extruder increases by using the third method, results more agreeable than those of the second method can be obtained.

This third method does, however, also have its shortcomings. Although the resistance uniformity offered by this method is much better than that of either the first or second methods mentioned above, the method does not provide sufficiently consistent desired resistance ranges to provide a feasible working product. As a result, scrap rates of unusable self-regulating heating cable are rather significant.

It would be desirable to develop a compound suitable for production of a self-regulating heating cable such that the compound would comprise a substantially uniform dispersion of conductive filler within a polymeric constituent.

It would be further desirable to develop a self-regulating heating cable offering a substantially uniform resistivity therethrough such that the cable would provide evenly dispersed heating.

The present invention contemplates a new and improved method which overcomes all of the above referred problems and others and provides a self-regulating heating cable comprised of a polymeric constituent which offers substantially uniform resistivity throughout.

BRIEF DESCRIPTION OF THE INVENTION

In accordance with the present invention, there is provided a method for producing a self-regulating heating cable that is substantially uniform in resistance.

In accordance with a more limited aspect of the invention, there is provided a method for producing a self-regulating heating cable. A first conductive constituent is cryogenically cooled to a temperature at least as low as its glass transition temperature. The first conductive constituent is then ground into first conductive pellets. A second conductive constituent is then cryogenically cooled to a temperature at least as low as its glass transition temperature. This second conductive constituent is ground into second conductive pellets. Next, the first and second conductive pellets are mixed together to obtain an extrudable mixture. Finally, the extrudable mixture is extruded over a pair of conductive wires.

Further in accordance with the present invention, a self-regulating heating cable is provided. The cable comprises at least two electrodes which can be connected to a source of electrical power. A positive temperature coefficient (PTC) element is extruded over and around the electrodes, with the PTC element including a PTC conductive polymer composition which comprises a polymeric composition and a conductive filler component that is uniformly dispersed therein. The PTC conductive polymer composition exhibits substantially uniform resistivity along separate, predetermined lengths of the heating cable.

A principle advantage of the invention is that the resultant polymeric constituent includes a uniform dispersion of conductive filler so that the resistivity throughout the subsequently formed self-regulating heating unit is also uniform.

Another advantage of the invention is that it provides a self-regulating heating cable that evenly discharges heat therefrom.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof.

FIG. 2 shows a schematic representation of a cryogenic cooling and grinding system.

FIG. 3 is a perspective view of a portion of a self-regulating heating cable fashioned in accordance with the present invention.

DETAILED DESCRIPTION OF THE PREFERRED EMBODIMENT

Figure 1:
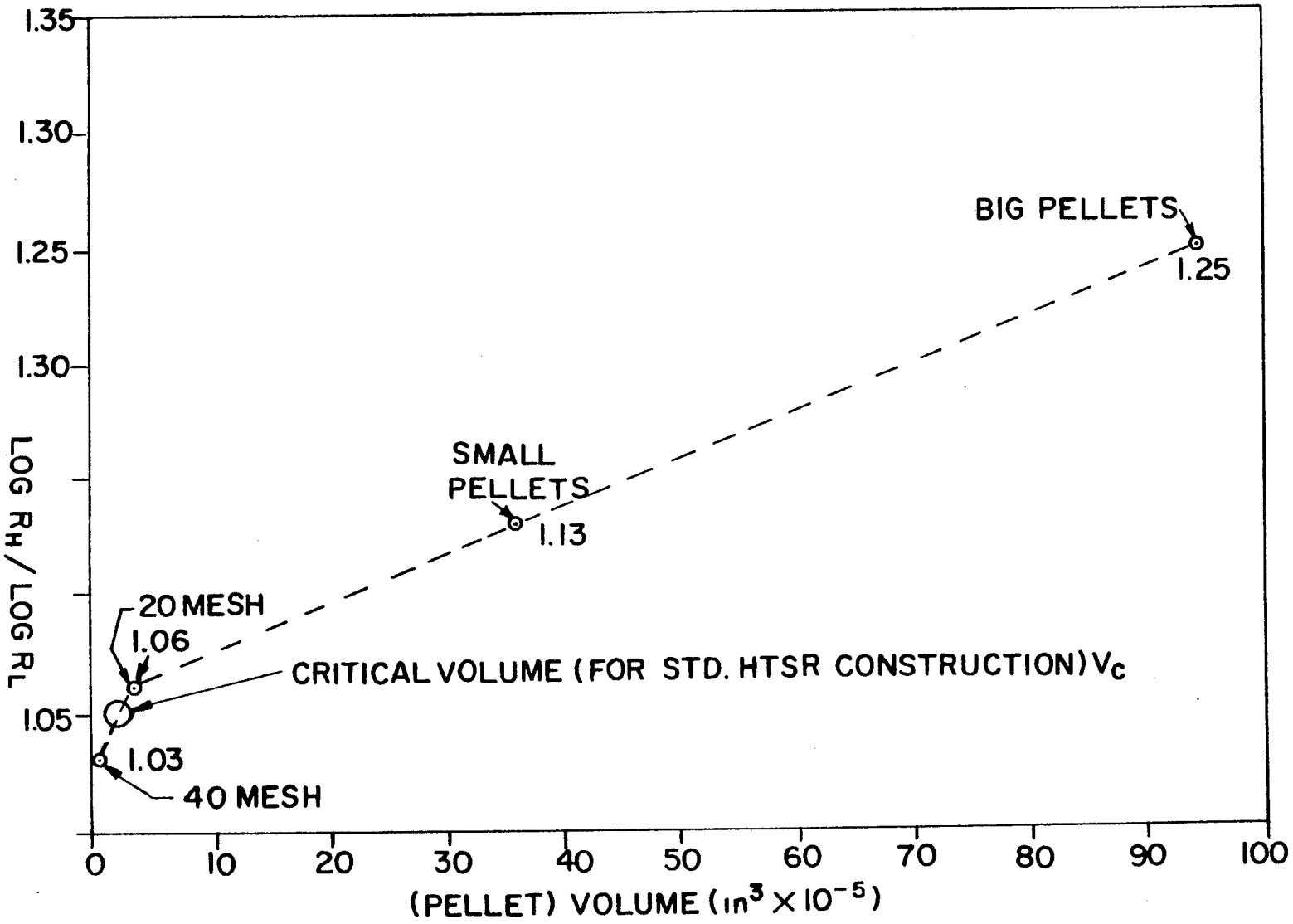
FIG. 1 is a graph showing a relationship between pellet volume and a ratio of the logarithm of a high resistance value in a cable to the logarithm of a low resistance value in the same cable.

A self-regulating heater is comprised of two parallel conductors joined together by a semi-conductive material. Typically, the material is comprised of a semi-conductive positive temperature coefficient (PTC) polymer that creates a resistance path between a pair of conducting wires. As a result, the cable exhibits heat loss when a current is passed therethrough.

Because the resistance value of the polymer increases with increasing temperature, the cable is rendered self-regulating. Thus, as the cable heats up, the resistance of the PTC polymer also increases causing the power losses to decrease. Conversely, when the cable cools, the resistance of the PTC polymer drops, causing an increase in heat output.

A PTC polymer is a polymeric material that includes a conductive filler. While the conductive filler can comprise a variety of materials such as powdered metals or graphite, carbon black is often preferred.

It has been discovered that a deviation of as little as 0.25% carbon black throughout the polymer produces a large fluctuation in the resistance value of the polymer once it has been extruded over the conductive wires. When the quantity of carbon black is not uniform throughout an extruded cable, extensive fluctuations in resistance are experienced. These fluctuations are ascribed to varying quantities of carbon black throughout the polymeric component of the cable. As a result, the resistance throughout the cable deviates by as much as $1\times10^2$ ohms-feet.

Since the resistance fluctuates to such a great extent, hot spots can be produced within the cable. Generally, the hot spots are attributed to a more-than-adequate amount of carbon black in the relevant area of the cable.

Alternatively, cold spots will be encountered. The cold spots normally arise because of a less-than-adequate amount or complete lack of carbon black in specific areas.

As can be readily understood, wide variations in the amount of carbon black throughout the polymeric constituent (either too much or too little) are likely to cause large scrap rates in the manufacture of heating cable.

In the practice of the present improved method, two constituents A and B are prepared. The constituents are formulated and processed into conductive pellet form. They are comprised of polymers or copolymers including polyolefins and/or fluoroelastomers; fillers such as $TiO_2$, ZnO or $CaCO_3$; and conductive components such as conductive carbon black. Constituent A is a polymer that is relatively lean in carbon black, and constituent B is a polymer that is relatively rich in carbon black.

Tables I and II illustrate conductive polymeric pellet compounds which are used to manufacture 3, 5, 10 and 15 Watt/120volt heaters as well as 3 and 5 Watt/240 volt heaters of the invention. Pellets produced in accordance with the composition set forth in Table I are relatively lean in conductive carbon black (7.5 weight %). By comparison, pellets produced in accordance with the composition set forth in Table II are relatively rich in conductive carbon black (11 weight %).

TABLE I

| Components | Parts by Weight |
|---|---|
| Tefzel 280 | 45.0 |
| Tefzel HT 2010 | 27.5 |
| Vulcan XC-72 | 7.5 |
| Kadox 515 | 20.0 |

TABLE II

| Components | Parts by Weight |
|---|---|
| Tefzel 280 | 38 |
| Tefzel HT 2010 | 31 |
| Vulcan XC-72 | 11 |

TABLE II-continued

| Components | Parts by Weight |
|---|---|
| Kadox 515 | 20 |

Tables III and IV illustrate conductive polymeric pellet compounds which are used to produce 10 and 15 Watt, 240 volt heaters. Pellets produced in accordance with the composition set forth in Table III are relatively lean in conductive carbon black (7.7 weight %). By comparison, pellets produced in accordance with the composition set forth in Table IV are relatively rich in conductive carbon black (11.8 weight %).

TABLE III

| Components | Parts by Weight | Percent by Weight |
|---|---|---|
| Tefzel 280 | 50 | 38.5 |
| Tefzel HT 2010 | 30 | 23.0 |
| Viton A-35 | 20 | 15.4 |
| Vulcan XC-72 | 10 | 7.7 |
| Kadox 515 | 20 | 15.4 |

TABLE IV

| Components | Parts by Weight | Percent by Weight |
|---|---|---|
| Tefzel 280 | 44 | 32.3 |
| Tefzel HT 2010 | 36 | 26.5 |
| Viton A-35 | 20 | 14.7 |
| Vulcan XC-72 | 16 | 11.8 |
| Kadox 515 | 20 | 14.7 |

TEFZEL and VITON are registered trademarks of E.I. du Pont de Nemours & Co. Inc. VULCAN is a registered trademark of Cabot Corporation. KADOX is a registered trademark of N.J. Zinc Company Inc. The TEFZEL HT 2010 is a powdered form of TEFZEL 280.

TEFZEL 280 and TEFZEL HT 2010 are fluoropolymers comprising ethylene tetrafluoroethylene (ETFE). The low temperature of embrittlement of the TEFZEL compounds is known to be below $-100°$ C. or $-150°$ F. The short term dielectric strength is 400 volts/mil at 125 mils, and over 2000 volts/mil at 10 mils. Volume resistivity is over $1\times10^{16}$ ohm-cm, and surface resistivity is over $1\times10^{14}$ ohm/sq.

VITON A-35 is a fluoroelastomer composed of a vinylidene fluoride hexafluoropropene copolymer. While the mentioned ETFE and vinylidene fluoride hexafluoropropene compositions are preferred polymeric compositions for use in connection with the present invention, other polymers, copolymers, and elastomers can be used as well. These include perfluoroalkoxy (PFA), fluorinated ethylenepropylene (FEP), polyvinylidene fluoride (PVDF), polyvinyl fluoride (PVF), polyamides, polyphenylene sulfide, polyesters (thermoplastic and thermoset), phenolics, silicones, epoxys, and styrenics. Further, polyolefins such as polyethylene and copolymers thereof, polypropylene and copolymers thereof, as well as ethylene vinyl acetate (EVA) and copolymers thereof can be used, either alone or in combination.

In addition, the ETFE and vinylidene fluoride hexafluoropropene components can be readily copolymerized with other components such as polyvinylidene fluoride for purposes of the present invention.

VULCAN XC-72 is a preferred carbon black constituent. The surface area of this particular conductive carbon black is about 254 sq. meters per gram. As stated above, other conductive fillers such as powdered metals and graphite can be used in connection with the present invention.

The remaining components used in preparing the conductive polymeric pellets include ZnO, $TiO_2$, Silica, ZnS, and $CaCO_3$. These components are used to act as fillers.

Conductive pellets having compositions corresponding to the formulations in Tables I–IV are prepared. First, powdered carbon black, powdered ETFE and ZnO are mixed together. The pellet form of ETFE is then added, and the components are mixed in a Henschel mixer. Thereafter, the group of components is melted together and then thoroughly mixed, and passed through a screw extruder. The material is extruded in elongated strands which are quickly cut into pellets having a volume in the range of 30 to $90\times10^{-5}$ in$^3$. Once the pellets have dried and hardened, they can be used in preparing the heating cables of the present invention.

Alternatively, a slow-extrusion process can be used to form pellets of sufficiently small volume such that they can be directly incorporated into the self-regulating heating cable without the need for cryogenic cooling and milling. In other words, the extruded polymer strands can be drawn to an extremely small diameter. The cylindrical pellets which are subsequently cut from these drawn-down strands are much smaller in both diameter and length in comparison to those developed in the method described above. If the resultant pellets are sufficiently small in size, the steps of cryogenically cooling and subjecting of pellets to a hammer mill can be omitted.

Self-regulating heating cables produced in accordance with the present invention have resistance ranges set forth in Table V. Of course, the parameters of self-regulating heating cables are not limited to those set forth in Table V, but the information is provided by way of illustration.

TABLE V

| Resistance Ranges of Self-Regulating Heat Cables | | |
|---|---|---|
| Watts | Ohms | Voltage |
| 3 | 3,500–5,750 | 120 |
| 5 | 1,350–3,500 | 120 |
| 10 | 950–1,300 | 120 |
| 15 | 650–900 | 120 |
| 3 | 17,000–25,000 | 240 |
| 5 | 6,800–17,000 | 240 |
| 10 | 2,000–4,400 | 240 |
| 15 | 1,000–1,900 | 240 |

Once the desired operating parameters of the heating cable have been determined, a suitable polymeric composition can be prepared.

As stated above, a first constituent A comprises a polymer that is lean in carbon black. That is, the percentage of carbon black in the polymeric constituent is typically in the range of 0 to 9%. The second constituent B which is deemed to be rich in carbon black includes carbon black at a percentage of typically 9 to 25%. By varying the amount of conductive carbon black in semi-crystalline polymers, the room temperature resistance of the polymer changes as well. It should be noted that the use of a different type of black could change these ranges considerably. Other ranges will be applicable depending on the particular polymers, carbon black, fillers, and mixing methods used, which all effect conductivity of the final product.

Once these pelleted constituents A and B have been formulated, a sampling of various blends of A and B is prepared. The resistivities of the various blends are plotted on a graph, and an ideal blend for a desired resistance value can be interpolated from the resultant curve.

For example, the following combinations of blends may be prepared: 10% A, 90% B; 20% A, 80% B; 50%A, 50%B; 80%A, 20% B; and 90% A, 10%B. Each of these blends is extruded over conductive wires, and a resistance value for each is determined.

A plot of resistivity vs. the blend percentage of A and B is prepared, and an ideal blend corresponding to desired resistivity is determined from the curve of the graph. Once the optimum blend of A and B has been determined, the corresponding amounts of the constituents are mixed together and subsequently extruded between and around two parallel conductive wires.

After the polymeric composition has been properly blended, extruded and hardened, it is possible to test the uniformity of the resistivity throughout the cable by measuring the resistance along 1' increments. By plotting a graph of the resistance for each consecutive 1' segment, a determination as to whether the resistivity is suitably constant can be made.

When semi-conductive polymeric constituents were prepared in the past, it was discovered that plots of the resistance against each 1' increment produced drastically varying sinusoidal waves, with upper and lower extremes differing by as much as $1\times10^2$ ohms-feet. Such a vast oscillation in resistance presented the problems discussed above in the Background of the Invention. That is, resultant heating cables provided many hot spots as well as many cold spots, and cable scrap rates were high. At high resistance, many cold spots developed. At low resistance, hot spots developed.

A plot of the resistance across 1' segments of the cable formed in accordance with the present invention shows much less variation with respect to resistance. In fact, it has been determined that a ratio of the logarithm of the highest resistance measured along any one foot segment of the cable of the present invention to the logarithm of the lowest resistance measured across any other one foot segment is generally less than or equal to 1.06. This ratio occurs when the mean particle size of constituents A and B is about 20 mesh. When the mean particle size of constituents A and B is between 20 and 40 mesh, the ratio typically ranges between 1.03 and 1.05. These low ratios evidence the fact that the resistance throughout the cable produced in accordance with the present invention is substantially uniform in that resistance variance is maintained within a desirable range.

Uniformity in resistance is attributed to a substantially even distribution of carbon black throughout the polymeric constituent portion of the cable. A reduction in particle size of constituents A and B assures an acceptable uniformity in the amount of carbon black throughout the resultant cable.

Turning now to FIG. 1, a graph of pellet volume vs. a ratio of the logarithm of the high resistance $R_h$ to the logarithm of the low resistance $R_l$ is shown. The high resistance $R_h$ is the higher of any two resistances measured along two separate 1' increments of the resultant cable. The low resistance $R_l$ is the lower of the two resistances.

As will be noted, when larger pellets are used, i.e., those on the order of $90\times10^{-5}$ in$^3$, the resultant cable has a widely varying resistivity. When measurements of the resistivity along 1' increments of a cable were taken, the ratio of log $R_h$ log $R_l$ was determined to be about 1.25. The cable formed in accordance with the larger pellets had many hot spots and cold spots and was considered defective.

Similarly, when smaller pellets, i.e., those on the order of about $35\times10^{-5}$ in$^3$ were used in preparing a self-regulating heating cable, it was determined that the resistance was slightly more evenly distributed, although the disparity was still undesirable. The resistance somewhat widely fluctuated throughout the cable, and the ratio of the log $R_h$ log $R_l$ measured to be about 1.13.

As can be seen by the graph in FIG. 1, when pellets were reduced to the size of about 20 mesh, a resistance ratio of 1.06 is obtained. Pellets of the size of about 40 mesh provide a resistance ratio of about 1.03. In light of the results depicted in FIG. 1, it has been determined that a critical volume for pellets used in producing a standard self-regulating heating cable would be a volume which provides a resistance ratio of about 1.05, with the size of the pellets falling somewhere between 10 and 52 mesh, preferably between about 20 and 32 mesh.

Standard grinding methods are unable to sufficiently and consistently reduce the pellet size to a desired range. The present invention teaches an alternative to the standard grinding method. The method of the present invention permits the achievement of pellets within the desired mesh size range.

In order to reduce the pellet size to a desirable mesh range, larger already-available pellets comprising polymeric materials and conductive filler are cryogenically cooled to a temperature below their glass transition temperature, defined as the temperature at which a pellet will shatter when struck. The cooled materials are then subjected to a hammer mill. In this invention, fluoropolymer-based conductive pellets such as those comprising ethylene tetrafluoroethylene (ETFE) or a vinylidene fluoride hexofluoropropene copolymer are cryogenically cooled to about −200° to −220° F. and then ground.

Referring now to FIG. 2, a schematic of a cryogenic cooling system and hammer mill is shown. Materials 20 to be cooled and ground are fed into a screw extruder 24 through an inlet 28. The materials 20 include those polymeric conductive pellets discussed above.

Liquid nitrogen stored in a tank 30 is passed into the shell of the screw extruder at 34 or through heat exchange coils (not shown). The liquid nitrogen serves to cool the area within the screw extruder to substantially low temperatures. As the materials are passed along through the extruder by the screw 36, they are cooled to temperatures below −135° F., sufficiently below their glass transition temperatures. The glass transition temperature ($T_g$) of Tefzel 280 is about −93° C. That of VIton A-35 is about −30° F.

When the materials are sufficiently cooled to their glass transition temperatures, they become brittle and in condition for being shattered into smaller pieces upon being subjected to hammer grinding mill 38.

By the time they have reached the end of the screw extruder, the materials have reached their glass transition temperature and have thus become significantly brittle. They are then fed into a hammer grinding mill 38 wherein they are ground or exploded into broken down or smaller pieces and then discharged. The output materials are repeatedly passed through the cryogenically cooling and grinding process until a desired range in mesh size is achieved. That is, once the materials have passed through the hammer mill, they are again entered into the system for additional passings through the cooling chamber and hammer mill. The final size of the materials output from the hammer mill 38 can be controlled by the number of passes through the hammer mill and by the temperature within the screw extruder.

As stated, it is desirable to reduce the size of the conductive polymeric materials to somewhere between 10 and 52 mesh. Materials below 52 mesh are reduced to "dust" and are quite difficult to work. Also, because they are so dusty, they can provoke health hazards.

As can be seen in the graph of FIG. 1, the ratio of log $R_h$ to log $R_l$ is in a desirable range beginning with particles as small as 20 mesh. The line apparently curves so that it eventually approaches uniform resistivity (log $R_h$ over log $R_l$=1.00) at a pellet volume somewhat smaller than 40 mesh.

Since it is virtually impossible to cryogenically cool and grind conductive polymeric pellets to uniform sizes, it is sufficient to grind them to a range of 10–52. mesh. Anything larger than 10 mesh or smaller than 52 mesh will be undesirable.

Preferably, the particle size will be limited to a range of 20–40 mesh. Most ideally, however, are particle sizes ranging between 20 and 32 mesh. It has been determined that a group of particles having a mean size ranging between 20 and 32 mesh offers substantial uniform resistivities across a cable wherein the ratio of log $R_h$ to log $R_l$ is somewhere between about 1.06 and 1.05, while smaller particles, those around 40 or 50 mesh, offer a product having more uniform resistivity. The particles of that smaller size are much more difficult to work with. As stated, once the particles reach a size as small as 52 mesh, they become undesirable for use in the present application. Accordingly, particles having a mean size of between 20 and 32 mesh offer the most ideal resistivity ratio coupled with the most desirable processability.

In the preferred embodiment of the invention, pellets which are rich in a conductive filler such as carbon black are cryogenically cooled and ground to a mean particle volume of 20–32 mesh. Particles which are lean in a conductive filler component such as carbon black are similarly cryogenically cooled and ground to a mean mesh size of 20–32 mesh. By having such a small mesh size, the particles are able to be thoroughly mixed together to provide a fairly uniform distribution of conductive carbon black throughout. As a result, once the thoroughly mixed particles are extruded over a pair of conductive bus wires, the resistance throughout the formed cable will be substantially uniform.

Turning now to FIG. 3, a final product cable 40 is shown. The cable can be extruded to any desirable length, and it is typically extruded to lengths of 350–500′ or more. The final product comprises a pair of parallel bus wires 44 and a conductive polymeric coating 46 extruded therearound. In order to test the uniformity of the resistance throughout the cable, the cable is divided into equal segments. In the present invention, the segments are measured at 1′ increments. The resistance across the length of each 1′ segment can be measured in ohms-feet, and the resulting resistance values are plotted on a graph. As stated above, it has been determined that the resistance of an entire length of cable is substantially uniform when the conductive polymeric composition is mixed together in accordance with the method set forth in the present invention.

The volume of one (1) foot of standard heating cable is approximately 0.3912 cubic inches. The volume of a standard 20 mesh particle is approximately $3.627\times10^{-5}$ cubic inches. Accordingly, a ratio of the standard heater volume to the standard particle size is approximately 10800:1. If the heater volume remains the same but the particle size is reduced to 40 mesh, that ratio becomes 124,600. At a particle size of 10 mesh, the ratio is about 1350:1. Accordingly, since 10 mesh is actually a maximum mean desirable particle size used in forming the heater, it is desirable that a minimum mean ratio of 1350:1 be maintained between a 1′ volume of heater and the volume of one particle.

Once the cable has been prepared, it may be desirable to anneal a length of it below its melting point to adjust resistance to a desired lower level. For example, a length of cable may be heated for anywhere from 4–48 hours at a temperature in the range of 190° C. to 250° C.

The annealing process generally both lowers the resistance of a cable and improves the uniformity of resistance throughout the cable. This effect is evident in cables produced using large pellets (i.e., those on the order of $35\times10^{-5}$ in$^3$), as well as those produced using pellets which have been significantly reduced in size (those on the order of 20–32 mesh) as a result of subjecting larger pellets to either cryogenically cooling and grinding steps or to slow extrusion steps.

The invention will be more clearly explained in the following example.

EXAMPLE

Pelletted materials comprising the compositions set forth in Tables I and II above were produced in accordance with standard mixing and pelletizing materials. That is, the components were mixed, melted, and extruded into lengths which were cut into appropriate pellet-sized pieces. The pellets corresponding to Table I were relatively lean in carbon black and labeled "A", and those corresponding to Table II were relatively rich in carbon black and labeled "B".

The pellets labelled A were cryogenically cooled to −200° F. and subjected to a hammer grinding mill to obtain resultant smaller pellets which ranged in mean size from 20–32 mesh. The pellets labelled B were similarly cooled and ground to the same mean size range.

A series of blends of the resultant smaller pellets of components labeled A and B were produced and extruded over a pair of bus wires. Resistivities across 1′ segments of the various extrusions were measured, and a graph comparing the resistivities with the blends was produced. In order to produce a 5W/120 volt cable having a resistance range of between 1350 and 3500Ω for 1′ segment, a blend of 47 parts A and 53 parts B was determined to be appropriate.

The appropriate blend was produced and extruded over a pair of bus wires to obtain a self-regulating heating cable of 100′ in length. After the cable hardened, it was divided into 100 1′ segments. The resistance value across each of these 1′ segments was measured, and a ratio of the logarithm of the highest level of resistance to the logarithm of the lowest level of resistance across any of the 1′ segments was determined to be 1.05.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

I claim:

1. A method for producing a self-regulating heating unit, comprising the steps of:

cryogenically cooling a first conductive constituent comprising a conductive filler to its glass transition temperature, said temperature being below at least −30° F.;

grinding the cryogenically cooled first conductive constituent to produce smaller first conductive pellets;

cyrogenically cooling a second conductive constituent comprising a conductive filler to its glass transition temperature;

grinding the second cryogenically cooled conductive constituent to produce smaller second conductive pellets;

mixing the first and second conductive pellets together to obtain an extrudable mixture, said first and second conductive pellets of a size sufficiently small enough to provide a substantially uniform distribution of conductive filler throughout the extrudable mixture; and extruding the mixture over a pair of conductive wires.

2. A method for producing a self-regulating heating unit, as set forth in claim 1, wherein a conductivity of the first conductive constituent is different from a conductivity of the second conductive constituent.

3. A method for producing a self-regulating heating unit, as set forth in claim 2, wherein a relative conductivity of the first and second constituents is determined according to a percentage of carbon black conductive filler present therein.

4. A method for producing a self-regulating heating unit, as set forth in claim 1, wherein the mixture includes a relatively uniform distribution of carbon black.

5. A method for producing a self-regulating heating unit, as set forth in claim 4, wherein log $R_h$/log $R_l$ is equal to or less than 1.06, $R_h$ being a resistivity along a selected first segment of the overall heating unit and $R_l$ being the resistivity along a selected second segment of the heating unit wherein $R_h$ is greater than $R_l$, the second segment being different from the first segment.

6. A method for producing a self-regulating heating unit, as set forth in claim 4, wherein log $R_h$/log $R_l$ is equal to or less than 1.05, Rh being a resistivity along a selected first segment of the heating unit and Rl being the resistivity along a selected second segment of the heating unit wherein Rh is greater than Rl, the second segment being different from the first segment.

7. A method for producing a self-regulating heating unit, as set forth in claim 1, wherein a mesh size of the first and second conductive pellets is in the range of about 10–52.

8. A method for producing a self-regulating heating unit, as set forth in claim 7, wherein the mesh size of the first and second conductive pellets is in the range of about 20–40.

9. A method for producing a self-regulating heating unit, as set forth in claim 7, wherein the mesh size of the first and second conductive pellets is in the range of about 20–32.

10. A method for producing a self-regulating heating cable, comprising the steps of:

cryogenically cooling first conductive polymeric pellets comprising a first conductive filler to their glass transition temperature, said temperature being below at least −30° F.;

grinding the conductive pellets to produce smaller first conductive particles ranging from about 10–52 mesh to provide a substantially uniform distribution of conductive filler among said first conductive particles; and extruding the first conductive particles over and between a pair of spaced conductive wires.

11. A method for producing a self-regulating heating cable, according to claim 10, comprising additional steps of:

cryogenically cooling second conductive polymeric pellets comprising a second conductive filler to a temperature at least as low as their glass transition temperature, said temperature being at least −30° F. or lower;

grinding the second conductive pellets to produce second conductive particles ranging from about 10–52 mesh; and mixing the first and second conductive particles together to obtain an extrudable mixture prior to extruding, the extrudable mixture having a substantially uniform distribution of first and second conductive filler therethrough.

12. A method for producing a self-regulating heating cable, as set forth in claim 10, wherein a mesh size of the first conductive particles is in the range of about 20–40.

13. A method for producing a self-regulating heating cable, as set forth in claim 10, wherein the mesh size of the first conductive particles is in the range of about 20–32.

14. A method for producing a self-regulating heating cable, according to claim 10, such that a measure of resistivity along a plurality of predetermined segments of the cable is substantially uniform.

15. A method for producing a self-regulating heating unit, comprising the steps of:

providing first conductive constituent having a first conductive filler therein and comprised of pellets having a mean volume between 10 and 52 mesh;

mixing a second conductive constituent having a second conductive filler therein and comprised of pellets having a mean volume between 10 and 52 mesh with said first conductive constituent to obtain an extrudable mixture, the extrudable mixture having a substantially uniform distribution of conductive fillers therethrough; and extruding the mixture over a pair of conductive wires to produce a cable having substantially uniform resistance.

16. A method for producing a self-regulating heating unit, as set forth in claim 15, wherein a relative conductivity of the first and second conductive constituents is determined according to a percentage of conductive filler present in each.

17. A method for producing a self-regulating heating unit, as set forth in claim 16, wherein said conductive filler is carbon black.

18. A method for producing a self-regulating heating unit, as set forth in claim 15, wherein the mixture includes a relatively uniform distribution of carbon black.

19. A method for producing a self-regulating heating unit, as set forth in claim 18, wherein log $R_h$/log $R_l$ is equal to or less than 1.06, $R_h$ being a resistivity along a first segment of the heating unit and $R_l$ being the resistivity along a second segment of the heating unit wherein $R_h$ is greater than $R_l$, the second segment being different from the first segment.

20. A method for producing a self-regulating heating unit, as set forth in claim 15, comprising the additional step of:

annealing the cable below its melting point to adjust a level of resistance thereof.

* * * * *